United States Patent [19]

Fujimura et al.

[11] Patent Number: 4,590,499

[45] Date of Patent: May 20, 1986

[54] HEAT-SENSITIVE RECORDING SHEET

[75] Inventors: Fumio Fujimura; Toshimi Satake; Manabu Mori; Toshiaki Minami; Tadakazu Fukuchi, all of Tokyo, Japan

[73] Assignee: Jujo Paper Co., Ltd., Tokyo, Japan

[21] Appl. No.: 762,918

[22] Filed: Aug. 5, 1985

[30] Foreign Application Priority Data

Aug. 15, 1984 [JP] Japan ..... 59-170153

[51] Int. Cl.[4] ..... B41M 5/18

[52] U.S. Cl. ..... 346/209; 346/200; 346/226; 427/150; 427/151; 427/152

[58] Field of Search ..... 346/200, 208, 209, 216, 346/226; 427/150, 151, 152

[56] References Cited

FOREIGN PATENT DOCUMENTS 0116690 7/1982 Japan ..... 346/209

0181892 11/1982 Japan ..... 346/209

*Primary Examiner*—Bruce M. Hess

*Attorney, Agent, or Firm*—Koda and Androlia

[57] ABSTRACT

Heat-sensitive recording sheet comprising a heat-sensitive color developing layer having particular chemicals on the support sheet and an overcoat layer laminated thereon and a backcoat layer on the back of the support sheet, wherein the sheet provides excellent coloring characteristics and high stability in storage.

6 Claims, No Drawings

HEAT-SENSITIVE RECORDING SHEET

BACKGROUND OF THE INVENTION

1. Field of the Invention

The present invention relates to a heat-sensitive recording sheet, and more particularly to a heat-sensitive recording sheet excellent in dynamic coloring characteristics and stability in storage.

2. Prior Art

Usually, a heat-sensitive recording sheet is made in the following manner. First, colorless or light-colored basic dyes and an organic developer such as a phenol-based substance are respectively ground to finely divided particles. After mixing them, a binder, filler, sensitivity improver, lubricant and other auxiliaries are added to the resultant solution to obtain a liquid for coating. The liquid for coating thus obtained is painted on a support such as a sheet, film or the like to obtain the heat-sensitive recording sheet. The resultant heat-sensitive recording sheet can obtain a colored record by a momentary chemical reaction with application of heat.

The heat-sensitive recording sheet is applied to a wide range of fields such as measuring recorders, terminal printers of computers, facsimile, automatic ticket vending machines, bar code labels, etc. Recently, the quality required for the heat-sensitive recording sheet has become higher with the diversification and high effectiveness of the recording machines. For example, with recording at high speed, highly dense and distinct colored pictures are required to be obtained even by a very low thermal energy. On the other side, a heat-sensitive recording sheet is required which is excellent in preservability such as plasticizer-resisting property, oil resisting property or water resisting property.

The latter requirement comes from the following problems. Namely, printed parts (colored parts) are decolored if sebaceous matters adhere to pictures or the pictures contact with a plasticizer (DOP, DOA, etc.) contained in a wrap film such as a PVC film or the like, salad oil, edible vinegar, water, etc. after the recording of the pictures. Further, if a liquid containing a polar volatile solvent, such as, for example, ethanol, whiskey or hairdressing, is splashed on a recording sheet, the texture portion of the sheet is colored. Both of these disadvantages are significant problems in using, handling and storing the thermal-sensitive recording paper.

Various methods of improving these problems are disclosed in the following public reports. They include a method in which a protective layer of a macromolecular compound such as a water-soluble resin is formed on the surface of the thermal-sensitive recording paper (Japanese Patent Laid-Open No. 57-144793), a method in which a metal salt of alkylxanthic acid is used as a developer for a thermal-sensitive layer on which an overcoat layer is formed (Japanese Patent Laid-Open No. 58-132592), a method in which two specific kinds of phenolic compounds are used as developers for a thermal-sensitive layer on which an overcoat layer is formed (Japanese Patent Laid-Open No. 58-136493), a method in which a specific developer and a specific auxiliary color coupler are added in forming a thermal-sensitive layer on which an overcoat layer is formed (Japanese Patent Laid-Open No. 58-151297), a method in which the thermal-sensitive recording paper is made by layering an undercoat layer principally consisting of a filler and a binding agent, a thermal-sensitive layer and an overcoat layer principally consisting of a water-soluble macromolecular binding agent and a filler in that order over a supporting body and a back-coat layer principally consisting of a water-soluble macromolecular binding agent is formed on the other surface of the supporting body (Japanese Patent Laid-Open No. 58-203092) and a method in which a polyvalent metal salt of a carboxylic acid is added in forming an overcoat layer or an undercoat.

These proposals have the common basic characteristic of physically preventing a plasticizer, salad oil, vinegar or a liquid containing a polar volatile solvent from penetrating into the thermal-sensitive recording layer by coating it with the overcoat layer, the undercoat layer and the back-coat layer. But, microscopic pinholes in these barrier layers would allow the above substance to permeate into the thermal-sensitive recording layer resulting in discoloration of colored picture images or coloration of uncolored areas.

Further, it is practically impossible to produce a film free of pinholes when forming the overcoat layer, the undercoat layer and the heat-sensitive layer on a support sheet on which the heat-sensitive layer is formed.

The inventor considered that those problems may be most perfect solved by providing a heat-sensitive recording layer in which colored images are not discolored and uncolored areas are not colored even when a plasticizer, salad oil, vinegar or a liquid containing a polar volatile solvent permeates through pinholes in the barrier layers into the heat-sensitive layer.

SUMMARY OF THE INVENTION

It is the general object of this invention to provide a heat-sensitive recording sheet having excellent plasticizer resistance, oil resistance and water resistance, assuming that the recording sheet has an excellent color density and clear image with minimized heat energy.

The above object has been achieved by adding monobenzyl calcium phthalate or zinc p-nitrobenzoate represented by the following general formula (I) or (II) used as a stabilizer to produce the heat-sensitive color-developing layer.

DETAILED DESCRIPTION OF THE INVENTION (I)

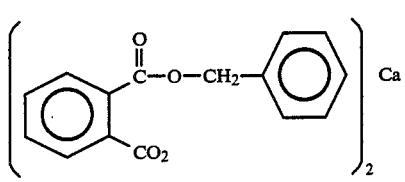

(II)

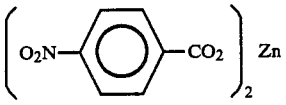

Monobenzyl calcium phthalate and zinc p-nitrobenzoate represented by the above formulae (I) and (II), as described by the applicants of this invention in Japanese Patent Application No. 58-153083 and in Japanese Patent Application No. 58-169269, work as stabilizers for oily substances.

In order to achieve the foregoing purpose, the heat-sensitive layer, the overcoat layer and the back-coat layer of the heat-sensitive recording sheet of this invention have been designed for the following functions.

(1) Thermal-sensitive Layer

The heat-sensitive layer of this invention has much better dynamic coupling sensitivity, plasticizer resistance, oil resistance and water resistance than the conventional heat-sensitive layer. It is composed of members such as basic colorless dye, an organic developer, a binding agent, a stabilizer (monobenzyl calcium phthalate or zinc p-nitrobenzoate), a filler, a sensitizer, a wax and a water resistance additive. Monobenzyl calcium phthalate or zinc p-nitrobenzoate which is a stabilizer used for this invention prevents plasticizers, oils and fats and solvents from penetrating through the pinhole in the barrier layer into the heat-sensitive layer to stabilize colored picture images. It is preferable that the concentration of the stabilizer in the heat-sensitive layer be 5–20 wt%.

The preferable organic color-developing agents of the present invention are: bisphenol A, 4-hydroxybenzoic acid esters, 4-hydroxyphthalic acid diesters, phthalic acid monoesters, bis-(hydroxyphenyl) sulfides, 4-hydroxyphenyl arylsulfones, 4-hydroxy-phenylaryl sulfonate, 1,3-di[2-(hydroxyphenyl)-2-propyl]-benzenes etc.

Examples of the above agents are as follows:

BISPHENOLS A 4,4'-isopropylidenediphenol (bisphenol A)
4,4'-cyclohexylidenediphenol
p,p'-(l-methyl-normalhexylidene)diphenol

4-HYDROXYBENZOIC ACID ESTERS 4-hydroxybenzoic acid benzyl ester
4-hydroxybenzoic acid ethyl ester
4-hydroxybenzoic acid propyl ester
4-hydroxybenzoic acid isopropyl ester
4-hydroxybenzoic acid butyl ester
4-hydroxybenzoic acid isobutyl ester
4-hydroxybenzoic acid methylbenzyl ester

4-HYDROXYPHTHALIC ACID DIESTERS 4-hydroxyphthalic acid dimethyl ester
4-hydroxyphthalic acid diisopropyl ester
4-hydroxyphthalic acid dibenzyl ester
4-hydroxyphthalic acid dihexyl ester

PHTHALIC ACID MONOESTERS

Phthalic acid monobenzyl ester
Phthalic acid monocyclohexyl ester
Phthalic acid monophenyl ester
Phthalic acid monomethylphenyl ester
Phthalic acid monoethylphenyl ester
Phthalic acid monoalkylbenzyl ester
Phthalic acid monohalogenebenzyl ester
Phthalic acid monoalkoxybenzyl ester

BIS-(HYDROXYPHENYL)SULFIDES

Bis-(4-hydroxy-3-tert-butyl-6-methylphenyl)sulfide
Bis-(4-hydroxy-2,5-dimethylphenyl)sulfide
Bis-(4-hydroxy-2-methyl-5-ethylphenyl)sulfide
Bis-(4-hydroxy-2-methyl-5-isopropylphenyl)sulfide
Bis-(4-hydroxy-2,3-dimethylphenyl)sulfide
Bis-(4-hydroxy-2,5-diethylphenyl)sulfide
Bis-(4-hydroxy-2,5-diisopropylphenyl)sulfide
Bis-(4-hydroxy-2,3,6-trimethylphenyl)sulfide
Bis-(2,4,5-trihydroxyphenyl)sulfide
Bis-(4-hydroxy-2-cyclohexyl-5-methylphenyl)sulfide
Bis-(2,3,4-trihydroxyphenyl)sulfide
Bis-(4,5-dihydroxy-2-tert-butylphenyl)sulfide
Bis-(4-hydroxy-2,5-diphenylphenyl)sulfide
Bis-(4-hydroxy-2-tert-octyl-5-methylphenyl)sulfide

4-HYDROXYPHENYLARYLSULFONATE 4-hydroxy-4'-isopropoxydiphenyl sulfone
4-hydroxy-4'-methyldiphenyl sulfone
4-hydroxy-4'-n-butyloxydiphenyl sulfone

4-HYDROXY PHENYLARYLSULFONATE 4-hydroxyphenylbenzene sulfonate
4-hydroxyphenyl-p-tolyl sulfonate
4-hydroxyphenyl methylene sulfonate
4-hydroxyphenyl-p-chlorobenzene sulfonate
4-hydroxyphenyl-p-tert-butylbenzene sulfonate
4-hydroxyphenyl-p-isopropoxybenzene sulfonate
4-hydroxyphenyl-1'-naphthaline sulfonate
4-hydroxyphenyl-2'-naphthaline sulfonate 1,3-DI[2-(HYDROXYPHENYL)-2-PROPYL]-BENZENES 1,3-di[2-(4-hydroxyphenyl)-2-propyl]-benzene
1,3-di[2-(4-hydroxy-3-alkylphenyl)-2-propyl]-benzene
1,3-di[2,4-dihydroxyphenyl)-2-propyl]-benzene
1,3-di[2-(2-hydroxy-5-methylphenyl)-2-propyl]-benzene

RESORCINOLES 1,3-dihydroxy-6($\alpha$,$\alpha$-dimethylbenzyl)-benzene

OTHERS p-tert-butylphenol
2,4-dihydroxybenzophenone
novolak-phenolic resin
4-hydroxyacetophenone
p-phenylphenol
benzyl-4-hydroxyphenyl acetate
p-benzyl phenol The above color-developing agents may be used either alone or in combination.

In order to obtain maximum dynamic image density, it is required to use p-hydroxy-benzoic acid benzyl ester as organic color developing agent, wherein monobenzyl calcium phthalate or zinc p-nitrobenzoate of the present invention provides the greatest effect as stabilization. The amount of such a color-developing agent in a color-developing layer is preferably within 10–40 weight-% on dry basis.

On the other hand, the species of the basic colorless dyestuffs of the present invention is not otherwise limited and it is preferable to use triphenylmethan dyestuffs, fluoran dyestuffs, azaphthalide dyestuffs, etc.

Examples of such dyestuffs are as follows.

TRIPHENYLMETHANE DYESTUFFS 3,3-bis(p-dimethylaminophenyl)-6-dimethylaminophthalide (crystall violet lactone)

FLUORAN DYESTUFFS 3-diethylamino-6-methyl-7-anilinofluoran
3-(N-ethyl-p-toluidion)-6-methyl-7-anilinofluoran
3-(N-ethyl-N-isoamyl)amino-6-methyl-7-anilinofluoran
3-diethylamino-6-methyl-7-(O,P-dimethylanilino)fluoran
3-pyrolidino-6-methyl-7-anilinofluoran
3-pyperidino-6-methyl-7-anilinofluoran 3-(N-cyclohexyl-N-methylamino)-6-methyl-7-anilinofluoran
3-diethylamino-7-(m-trifluoromethylanilino)fluoran
3-dibutylamino-7-(p-chloroanilino)fluoran
3-diethylamino-6-methyl-chlorofluoran
3-diethylamino-6-methyl-fluoran
3-cyclohexylamino-6-chlorofluoran
3-diethylamino-7-(o-chloroanilino)fluoran
3-diethylamino-benzo[a]-fluoran

AZAPHTHALIDE DYESTUFFS 3-(4-diethylamino-2-ethoxyphenyl)-3-(1-ethyl-2-methylindole-3-yl)-4-azaphthalide
3-(4-diethylamino-2-ethoxyphenyl)-3-(1-ethyl-2-methylindole-3-yl)-7-azaphthalide
3-(4-diethylamino-2-ethoxyphenyl)-3-(1-octyl-2-methylindole-3-yl)-4-azaphthalide
3-(4-N-cyclohexyl-N-methylamino-2-methoxyphenyl)-3-(1-ethyl-2-methylindole-3-yl)-4-azaphthalide The above dyestuffs may be used either alone or in combination. The solely use of the basic dyestuff, such as 3-diethylamino-6-methyl-7-anilinofluoran, 3-(N-cyclohexyl-N-methylamino)-6-methyl-7-anilinofluoran, 3-(N-ethyl-N-isoamyl)amino-6-methyl-7-anilinnofluoran or 3-(4-diethylamino-2-ethoxyphenyl)-3-(1-ethyl-2-methylindole-3-yl)-4-azaphthalide, provides a heat-sensitive recording sheet with a remarkably high dynamic image density.

The combined use of 3-diethylamino-6-methyl-7-anilinofluoran with 3-(N-cyclohexyl-N-methylamino)-6-methyl-7-anilinofluoran provides a heat-sensitive recording sheet haing a remarkably high dynamic image density, a superior oil-resistance and an improved stability in preserving.

The addition of such basic colorless dyestuff to a heat-sensitive developing layer is preferably within 5 to 20 weight-%.

For the sensitizer, a compound such as dibenzyl terephthalate, benzyl p-benzyloxybenzoate, di-p-tolylcarbonate, p-benzylbiphenyl or phenyl $\alpha$-naphthyl carbonate can be used.

For the binding agent, a water-soluble compound such as a polyvinyl alcohol, a carboxyl-group modified polyvinyl alcohol, methylcellulose, hydroxyethyl cellulose, carboxymethyl cellulose, polyvinyl pyrrolidone, polyacrylamide, polyacrylic acid, starch or gelatin or an aqueous emulsion of a compound such as styrene-butadiene latex, styrene-acrylic ester or vinyl acetate is used. Here, the above carboxyl-group modified polyvinyl alcohol is a reaction product obtained by causing a polyvinyl alcohol to react with a carboxylic acid such as fumaric acid, maleic acid, itaconic acid, maleic anhydride, phthalic anhydride, trimellitic anhydride or itaconic anhydride, a compound obtained by esterifying the above reaction product or a compound obtained by saponifying a copolymer prepared from vinyl acetate and a small quantity of an ethylenic unsaturated carboxylic acid such as maleic acid, fumaric acid or itaconic acid. It is preferable that the concentration of the above binding agent in the thermal sensitive layer be 25~45 wt%.

For water resistance additives, formaldehyde, glyoxal, chloric alum, melamine, melamine-formaldehyde resin, polyamide resin, polyamide-epichlorhydrin resin and epoxy resins can be used. It is preferable that the ratio by weight of such a water resistance additive to the above water-soluble macromolecular compound be 20~50 to 100.

A filler may not be contained in the thermal-sensitive layer but can be added according to necessity. Any organic or inorganic filler usually used in the field of paper manufacturing can be used as the filler. Minute granules of substances such as clay, talc, silica, magnesium carbonate, alumina, aluminum hydroxide, magnesium hydroxide, barium sulfate, kaolin, titanium oxide, zinc oxide, calcium carbonate, aluminum oxide, urea-formalin resin, polystyrene and phenol resin can be used as fillers.

Other agents consisting of a surface lubricant such as a fatty acid metal salt, a lubricant such as a wax and an anti-fogging (pressure-induced) agent (such as a fatty acid amide, ethylenebisamide, montan wax or polyethylene wax) can be added.

(2) OVERCOAT LAYER

The overcoat layer of this invention is for improving head matching. It inhibits the penetration of plasticizers, oils and fats, vinegar, water and solvents thereby improving the preservation and the durability of the picture images. This protective film contains polyvinyl alcohol or a carboxyl-group denatured polyvinyl alcohol and a filler as its essential components and may contain a water resistance additive, a surface lubricant and another water-soluble macromolecular binding agent. An especially favorable result can be achieved by forming 1~7 g per $m^2$ surface area of a protective layer containing 30~80 wt% of binding agents. If the percentage of binding agents is less than 30%, then the binding capacity will be decreased. If the percentage of binding agents exceeds 80%, then the thermal head will stick to the overcoat layer of the thermal-sensitive paper. In order to improve head matching, 0~15 wt% of a surface lubricant such as a fatty acid metal salt and a lubricant such as a wax can be added.

For the above carboxyl-group denatured polyvinyl alcohol, a reaction product obtained by causing polyvinyl alcohol to react with a carboxylic acid such as fumaric acid, maleic acid, itaconic acid, maleic anhydride, phthalic anhydride, trimellitic anhydride or itaconic anhydride, a compound obtained by esterifying the above reaction product or a compound obtained by saponifying a copolymer prepared from vinyl acetate and a small quantity of an ethylenic unsaturated carboxylic acid such as malic acid, fumaric acid or itaconic acid is used.

For the other water-soluble macromolecular binding agent used in addition to a polyvinyl alcohol or a carboxyl-group modified polyvinyl alcohol, methylcellulose, hydroxyethyl cellulose, carboxymethyl cellulose, polyvinyl pyrrolidone, polyacrylamide or polyacrylic acid can be used.

Formaldehyde, glyoxal, chloric alum, polyamideepichlorhydrin resin, epoxy resins, melamine and melamine-formaldehyde resin can be used as additives. It is preferable that the ratio by weight of the water resistance additive to the binding agent be 20~50 to 100.

Minute granules of substances such as clay, talc, kaolin, titanium oxide, zinc oxide, calcium carbonate, silica magnesium carbonate, alumina, aluminum hydroxide, magnesium hydroxide, barium sulfate, aluminum oxide, urea-formalin resin, polystyrene and phenol resin can be used as fillers.

In addition, when the water-soluble macromolecular binder used for forming the overcoat layer is a polyvinyl alcohol, it is preferable that the polyvinyl alcohol have a saponification rate of 95~100% and a polymerization degree of 100~500. POlyvinyl alcohols with a polymerization degree of 100~500 are preferred to polyvinyl alcohols with a polymerization degree of 500~2,500 because of the following advantages:

(1) Extremely few pinholes are produced during the process of film formation.

(2) Since such a polyvinyl alcohol can be dissolved in water in high concentration, a top coat color of high density can be achieved and drying is easily performed during the application process.

Polyvinyl alcohols with a saponification rate of 95~100% are more resistant to animal and vegetable oils, mineral oils and organic solvents than polyvinyl alcohls with a saponification rate of 90% or below.

(3) BACK-COAT LAYER

The back-coat layer of this invention contributes to improving the preservation performance and the stability of the picture images in the same manner as the overcoat layer. It also contributes to preventing curling of the recording paper. That is, the back-coat layer protects the thermal-sensitive layer by inhibiting the penetration of plasticizers, oils and fats, vinegar, water and solvents through the back surface of the supporting body into the thermal-sensitive layer. Additionally, due to the application of the two layers over the supporting body as well as due to the high concentration of a water-soluble macromolecular binding agent in the overcoat layer, the conventional heat sensitive recording sheet (consisting of a supporting body, a heat-sensitive layer and an overcoat layer coated over the supporting body) forms large curls during the application of the thermal-sensitive and the overcoat layers and at a relative humidity of 50% or below. The curling of the paper frequently causes facsimile machines to jam. These problems can be solved by the back-coat layer.

The back-coat layer of this invention principally consists of an aqueous emulsion binding agent of a hydrophobic macromolecular compound. It may also contain not more than 30 wt% of the aforementioned filler. Aqueous emulsions of polyvinyl acetate, vinyl chloride-vinyl acetate copolymers, styrene-butadiene-acrylic-system copolymers, polyester, styrene-butadiene latex and polyurethane can be used as aqueous emulsion binding agents. As compared to the conventional back-coat layer formed by using an aqueous macromolecular binding agent, a back-coat layer prepared by using the aqueous emusion binding agent of a hydrophobic macromolecular compound has the following advantages:

(1) Since the emulsion has a high concentration and a low viscosity, a low-viscosity high-density color can be achieved by controlling the color of the back coat and drying is easily performed during the application process.

(2) Water resistance additives normally required for water-soluble macromolecular binding agents are unnecessary.

Among the aqueous emulsions of hydrophobic macromolecular compounds, aqueous emulsion of a polyurethane compound is mot desirable because of the following reasons:

(1) It has high resistance to plasticizers, animal and vegetable oils, mineral oils and organic solvents.

(2) It has a remarkably high water resistance.

The amount of the back-coat layer is 1~5 g/m$^2$ preferably 4 g/m$^2$.

By giving the thermal-sensitive layer, the overcoat layer and the back-coat layer such specific functions as described above, the effects of these layers synergistically realize the following effects aimed for in this invention:

(1) High-sensitivity thermal-sensitive recording paper.

(2) Excellent durability such as plasticizer resistance, oil resistance and water resistance.

(3) Good head matching.

In preparation of a heat-sensitive recording sheet of the present invention, each of organic color-developing agent and basic colorless dystuff is, after addition of aqueous solution of water-soluble polymer, ground down to a particle size of 1-3 microns by means of a attritor, sand mill, etc. and in accordance with the purpose, various additives are added thereto to prepare coating solution. Such additives are as follows: filler, sensitizer, stabilizer, dispersant such as woxes; antifoamer; water resistance agent. The coating solution for overcoating and that for backcoating are produced, respectively, by mixing or dispersing filler, water-soluble polymer binder, slipping agent, etc.

The heat-sensitive recording sheet of the present invention may be obtained by applying a base sheet such as paper, laminate paper etc. with each of coating solution, successively.

This invention will now be described more specifically referring to examples.

EXAMPLE 1

Each of solutions having the following composition was ground in an attritor into three micron particle size to prepare solution A, B and C.

| | |
|---|---|
| Solution A (liquid dispersion of dyestuff) | |
| 3-diethylamino-6-methyl-(p-chloroanilino) fluoran | 2.0 parts |
| 10% aqueous solution of polyvinyl alcohol | 4.6 parts |
| Water | 2.5 parts |
| Solution B (liquid dispersion of color-developing agent) | |
| 4-hydroxybenzoic acid benzylester | 5 parts |
| Zinc stearate | 1 part |
| Aqueous 10% solution of polyvinyl alcohol | 29.5 parts |
| Water | 5.5 parts |
| Solution C (stabilizer dispersion) | |
| Calcium salt of monobenzylphthalic acid | 2 parts |
| Aqueous 10% solution of polyvinyl alcohol | 5 parts |
| Water | 3 parts |

The liquid dispersions was mixed at a ratio shown in Table to prepare a coating solution for heat-sensitive color-developing layer.

| | |
|---|---|
| Solution A (dyestuff dispersion) | 9.1 parts |
| Solution B (developing agent dispersion) | 41 parts |
| Solution C | 10 parts |

Then, the solution having the following composition was ground in an attritor to prepare a coating solution E for overcoating layer.

| Solution E | |
|---|---|
| Calciumcarbonate | 2 parts |
| Aqueous 10% solution of polyvinyl alcohol | 30 parts |
| Zinc stearate | 0.5 part |

A coating solution for back-coating layer was prepared by replacing polyvinyl alcohol in the solution with the identical parts by weight of polyurethane emission.

Each of the coating solutions was coated on one side of a base sheet of 50 g/m$^2$ so as to provide a coating amount of Table 1 and was dried. The sheet was treated in a supercalender so as to obtain the surface of a overcoating layer having a smoothness of 600–10000 seconds. The results of the quality performance tests carried out for the thus obtained black-color-developed heat-sensitive recording sheets are shown in Table 2.

EXAMPLE 2

Heat-sensitive recording sheet was prepared in the same manner as in Example 1 excepting the use of the following solution D instead of the solution C.

| Solution D (stabilizer dispersion) | |
|---|---|
| Zinc salt of p-nitropenzoic acid | 2 parts |
| Aqueous 10% solution of polyvinyl alcohol | 5 parts |
| Water | 3 parts |

EXAMPLE 3

Heat-sensitive recording sheet was prepared in the same manner as in Example 1 excepting the use of the following solution F instead of the solution E.

| Solution F | |
|---|---|
| Calcium carbonate | 2 parts |
| Aqueous solution of polyvinyl alcohol having a saponification degree of 97% and a polymerization degree of 300. | 30 parts |
| Zinc stearate | 0.5 parts |

EXAMPLE 4

Heat-sensitive recording sheet was prepared in the same manner as in Example 1 excepting both the use of the solution D instead of the solution C and the use of the solution F instead of the solution E.

COMPARATIVE EXAMPLE 1

Each of the solutions having the following composition was ground in an attritor into three micron particle size to form the solutions A and B.

| Solution A (liquid dispersion of dyestuff) | |
|---|---|
| 3-diethylamino-6-methyl-(p-chloroanilino)fluoran | 2.0 parts |
| 10% aqueous solution of polyvinyl alcohol | 4.6 parts |
| Water | 2.5 parts |
| **Solution B (liquid dispersion of color-developing agent)** | |
| 4-hydroxybenzoic acid benzylester | 5 parts |
| Zinc stearate | 1 part |
| Aqueous 10% solution of polyvinyl alcohol | 29.5 parts |
| Water | 5.5 parts |

Then, the solutions A and B were mixed at the following ratio to form a coating solution for heat-sensitive color-developing layer.

| | |
|---|---|
| Solution A (dyestuff dispersion) | 9.1 parts |
| Solution B (developing agent dispersion) | 41 parts |

The solution having the following composition was ground in an attritor to form the coating solution E for protective layer.

| Solution E | |
|---|---|
| Calcium carbonate | 2 parts |
| 10% aqueous solution of polyvinyl alcohol | 30 parts |
| Zinc stearate | 0.5 parts |

Polyurethane emulsion was used as back-coating layer.

Each of the coating solutions was coated on the base sheet of 50 g/m$^2$ in coating amount of Table 1 to form a heat-sensitive color-developing layer, a overcoating layer and a back-coating layer. After drying, the sheet was treated in a supercalender so as to obtain the surface of a overcoating layer having a smoothness of 600–1000 seconds.

COMPARATIVE EXAMPLE 2

Heat-sensitive recording sheet was prepared in the same manner as in Comparative Example 1 without a back-coating layer.

COMPARATIVE EXAMPLE 3

Heat-sensitive recording sheet was prepared in the same manner as in Comparative Example 1 without a overcoating layer and a back-coating layer.

With regard to the heat-sensitive recording sheets of Examples 1–4 and Comparative Examples 1–3, the test results are shown in Table 2.

TABLE 1

| | The coating amount (g/m$^2$) of each layer in heat-sensitive recording sheets | | | | | | |
|---|---|---|---|---|---|---|---|
| | Examples | | | | Comparative Examples | | |
| | 1 | 2 | 3 | 4 | 1 | 2 | 3 |
| Overcoating layer | 4.2 | 4.2 | 4.2 | 4.2 | 4.2 | 4.2 | — |
| Heat-sensitive color-developing layer | 6.0 | 6.0 | 6.0 | 6.0 | 6.0 | 6.0 | 6.0 |
| Base sheet | | | | | | | |
| Back-coating layer | 4.0 | 4.0 | 4.0 | 4.0 | 4.2 | — | — |

TABLE 2

| | | | | Test Results | | | | | | | |
|---|---|---|---|---|---|---|---|---|---|---|---|
| | | | | Head matching property (3) | | Oil Resistance (4) | | | Plasticizer resistance (5) | | |
| | Stabilizer (1) | Binder in overcoat layer | Dynamic coloring density (2) | Sticking of paper | Head work-up | Un-treated | After treat-ment | Residual rate (%) | Un-treated | After treat-ment | Residual rate (%) |
| Example | | | | | | | | | | | |
| 1 | MBP—Ca | Polyvinyl alcohol | 1.40 | good | good | 1.40 | 1.26 | 90 | 1.40 | 1.19 | 85 |

TABLE 2-continued

| | | | | Test Results | | | | | | | |
|---|---|---|---|---|---|---|---|---|---|---|---|
| | | | | Head matching property (3) | | Oil Resistance (4) | | | Plasticizer resistance (5) | | |
| | Stabilizer (1) | Binder in overcoat layer | Dynamic coloring density (2) | Sticking of paper | Head work-up | Un-treated | After treat-ment | Residual rate (%) | Un-treated | After treat-ment | Residual rate (%) |
| 2 | PNB—Zn | Polyvinyl alcohol | 1.41 | good | good | 1.41 | 1.27 | 90 | 1.41 | 1.18 | 84 |
| 3 | MBP—Ca | Polyvinyl alcohol (Saponification rate 97%; poly-merization degree: 300) | 1.39 | good | good | 1.39 | 1.32 | 95 | 1.39 | 1.26 | 91 |
| 4 | PNB—Zn | Polyvinyl alcohol (Saponification rate 97%; poly-merization degree: 300) | 1.40 | good | good | 1.40 | 1.33 | 95 | 1.40 | 1.26 | 90 |
| Com-parative example | | | | | | | | | | | |
| 1 | — | Polyvinyl alcohol | 1.41 | good | good | 1.40 | 0.70 | 50 | 1.40 | 0.56 | 40 |
| 2 | — | Polyvinyl alcohol | 1.40 | good | good | 1.40 | 0.02 | 1 | 1.40 | 0.02 | 1 |
| 3 | — | — | 1.40 | bad | — | 1.40 | 0.02 | 1 | 1.40 | 0.02 | 1 |

Comparing the examples with the corresponding comparative examples in Table 2, it is found that the heat-sensitive recording sheet of the invention, which containing calcium monobenzyl phthalate or zinc p-nitrobenzoate in a heat-sensitive coloring layer and having a overcoat layer and a backcoat layer, is very excellent in oil resistance and plasticizer-resisting property. Further, it is also excellent in head matching property. In addition, the above effect is most marvelous in the heat-sensitive recording sheet in which polyvinyl alcohol having a saponification value of 97% and a polymerization degree of 300 is used as a binder for the overcoat layer.

What is claimed:

1. A heat-sensitive recording sheet comprising on the surface of the support sheet a heat-sensitive color-developing layer containing colorless basic dye and an organic color developer, and a overcoat layer on said heat-sensitive color-developing layer and a back-coat layer on the back side of the support, said heat-sensitive color-developing containing calcium monobenzyl phthalate or zinc p-nitrobenzoate of the following general formula (I) or (II) as a stabilizer;

(I)

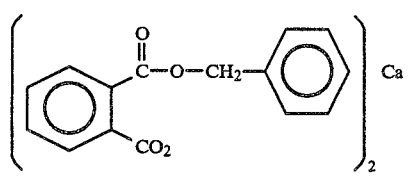

(II)

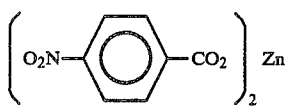

2. A heat-sensitive recording sheet according to claim 1, wherein said overcoat layer contains polyvinyl alcohol or carboxyl group-modified polyvinyl alcohol and a filler, and said backcoat layer contains an emulsion binder as a chief component.

3. A heat-sensitive recording sheet according to claim 2, wherein said polyvinyl alcohol has a saponifaction value of 95–100% and a polymerization degree of 100–2000.

4. A heat-sensitive recording sheet according to claim 2, wherein said emulsion binder is a polyurethane compound.

5. A heat-sensitive recording sheet according to claim 1, 2, 3 or 4, wherein said organic developer is benzyl p-hydroxybenzoate.

6. A heat-sensitive recording sheet according to claim 5, wherein the amount of benzyl p-hydroxybenzoate is within the range of 10–40 weight-% on dry basis, with respect to the total weight of the color developing layer.

* * * * *